United States Patent [19]

Smith

[11] 4,263,718

[45] Apr. 28, 1981

[54] ARCHERY ATTACHMENT BRACKET

[76] Inventor: Jimmie T. Smith, P.O. Box 667, Bixby, Okla. 74008

[21] Appl. No.: 8,786

[22] Filed: Feb. 1, 1979

[51] Int. Cl.[3] ..... F41G 1/00

[52] U.S. Cl. ..... 33/265; 124/87

[58] Field of Search ..... 124/22, 23 R, 24 R, 124/41 A, 88, 86; 33/265

[56] References Cited

U.S. PATENT DOCUMENTS

| | | | |
|---|---|---|---|
| 2,574,599 | 11/1951 | Stieber | 124/23 R |
| 2,900,973 | 8/1959 | Diehr | 124/24 R |
| 3,245,393 | 4/1966 | Rose | 124/24 R |
| 3,271,863 | 9/1966 | Harrington | 33/265 |
| 3,590,489 | 7/1971 | Saunders | 33/265 |
| 3,787,984 | 1/1974 | Bear et al. | 33/265 |
| 4,136,462 | 1/1979 | Topel | 33/265 |
| 4,159,575 | 7/1979 | Kalmbach | 33/265 |

*Primary Examiner*—William R. Browne

*Attorney, Agent, or Firm*—James H. Chafin

[57] ABSTRACT

An attachment bracket for attaching auxiliary equipment such as bow sights and quivers to various archery bows. The bracket includes a central threaded attachment bore for mating with the threaded attachment bore of the bow and a pair of radially extending slots and associated drill indentation locator pins for mating with drill indentations provided on various bows, regardless of the distances of said drill indentations from the threaded central bore.

3 Claims, 6 Drawing Figures

ARCHERY ATTACHMENT BRACKET

BACKGROUND OF THE INVENTION

1. Field of the Invention

The present invention relates to accessory attachment bracketry and more particularly, but not by way of limitation to the universal attachment bracket for securing archery accessories to previously manufactured bows.

2. History of the Prior Art

With the advent of the compound or pulley-equipped archery bow, there has been a renewed interest in archery. The compound bow is easier to operate and accuracy has been greatly increased. Thus many archers now utilize adjustable bow sights which must be attached to the bow in some manner.

Although most bow manufacturers sell bow sights and other accessories that may be attached to the bow, they sell these accessories separately and provide means carried by the bow to permit attachment of their particular equipment to the bow.

Apparently, to encourage the use of the manufacturer's accessories, the compound bows are provided with hole patterns which are particularly designed for their own equipment and not for equipment provided by other manufacturers.

While most bow manufacturers provide a fairly standard center tapped bore for attaching such equipment, they often, on either side of that bore have smaller tapped bores or drill location indentations thereby forming a hole pattern which is particularly suited for their own accessory equipment. The hole patterns provided on most bows have different spacing and hence, the manufacturers of accessory equipment have to stock various configurations of attachment brackets to permit the use of their equipment on the various makes of compound bows.

Hence, if the user of the bow employs one or more of the various accessories, he must either find bracketry which will fit the particular hole pattern provided on the bow or he must drill and tap his bow to the hole pattern provided by the accessories. If the user's skills in the workshop are inadequate, he must have the work done or chance marring the bow doing the work himself.

SUMMARY OF THE INVENTION

The present invention provides an attachment bracket which may be used with practically any manufactured bow without the need to drill or otherwise perform any modification to that bow.

Since the center tapped bore is substantially uniform among the various bow manufacturers, the present univesal bracket is provided with a central bore and a screw member for basic attachment to the bow.

The attachment bracket is also provided with a pair of oppositely disposed radially extending slots on each side of the central bore. Slidably carried in each slot is a pin or shaft member, the inside end of which is rounded and provided with a flange.

Thus, each pin or shaft is aligned with the auxiliary bores or drill location indentations and the rounded end of the shaft extends into the indentation so that when the center screw is tightened, the shaft or pin members prevent rotation of the bracket about the center screw. Therefore, once the bracket is installed, it it firmly attached to the bow without the user having had to alter the bow in any way.

DESCRIPTION OF THE DRAWINGS

Other and further advantageous features of the present invention will hereinafter more fully appear in connection with the detailed description of the drawings in which.

DESCRIPTION OF THE PREFERRED EMBODIMENT

Figure 1:
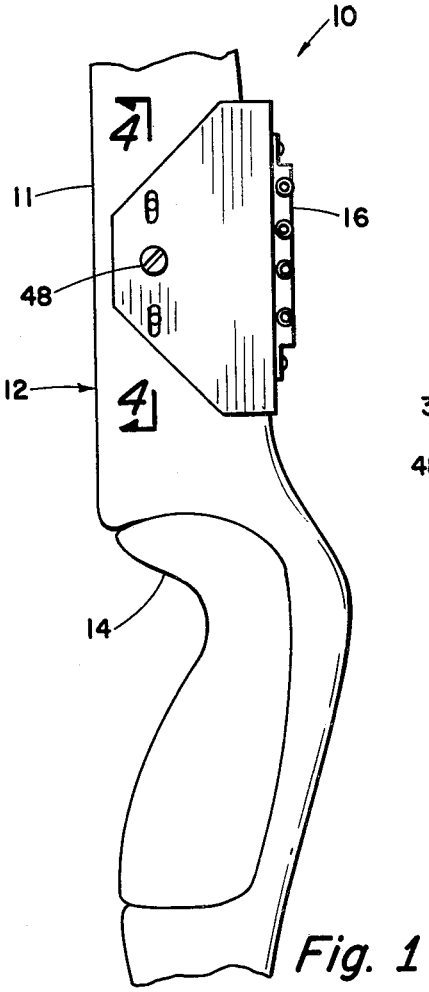
FIG. 1 is a side elevational view of a portion of a compound bow having a bracket embodying the present invention.
Figure 2:
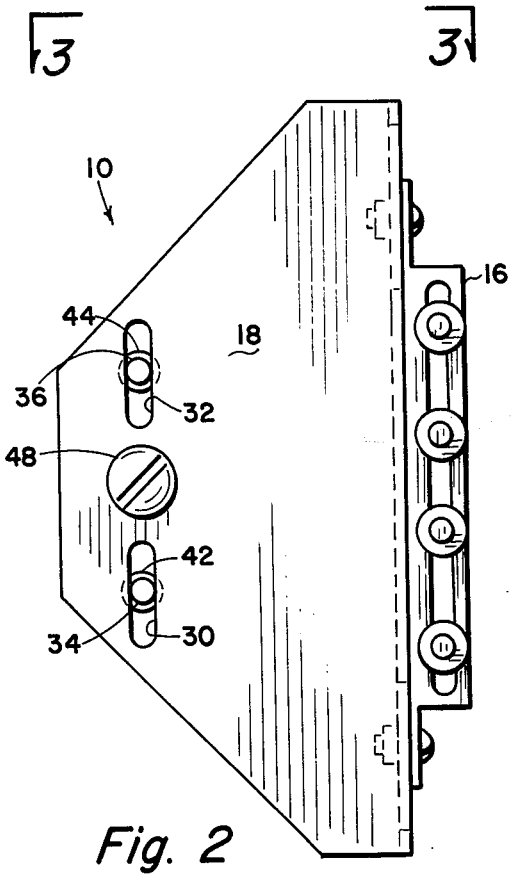
FIG. 2 is a side elevational view of a bracket of FIG. 1.

Referring to the drawings in detail, reference character 10 generally indicates an accessory attachment bracket which is secured to the body 11 of a compound bow generally indicated by reference character 12 above the handle member 14.

The particular bracket 10 shown herein is for the purpose of mounting an adjustable bow sight 16, it being undestood that the bracket 10 or a similar bracket may be utilized for mounting other accessories such as a side mounted quiver (not shown).

The bracket 10 generally comprises a flat plate portion 18, a front edge of which is provided with a right angle or flange portion 20 for attachment of the bow sight 16 or other accessory.

Figure 4:
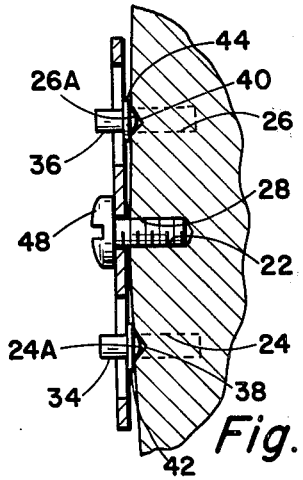
FIG. 4 is an elevational sectional view of the bracket taken along the broken line 4—4 of FIG. 1.
Figure 3:
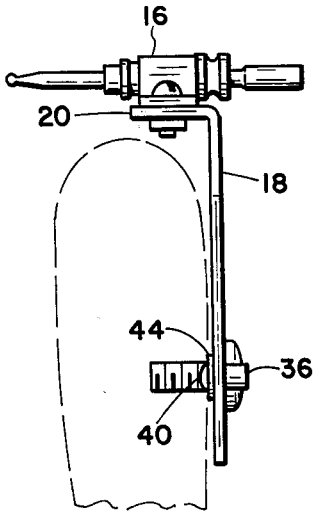
FIG. 3 is a top plan view of the bracket of FIG. 1.

In the side of the body portion 11 of the bow 12, there is normally provided a threaded or tapped bore 22 for the purpose of mounting accessories to the bow. Normally, spaced on either side of the bore 22 are auxiliary bores 24 and 26 shown by the dashed lines in FIG. 4, or in the alternative a pair of drill locator indentations 24A and 26A also shown in FIG. 4.

Centrally disposed in the rear portion of the plate member 18 is a bore 28 which conforms in size to the typical tapped bore 22 provided in various compound bows.

A pair of oppositely disposed radially extending elongated slots 30 and 32 are provided in the plate member 18 above and below the central bore 28. Slidably disposed in each slot 30 and 32 are pin members 34 and 36 respectively. The inner end of the pin members are provided with hemispherically rounded surfaces 38 and 40 respectively. Each pin is provided with a circular flange member 42 and 44, respectively, which surrounds the pin member and are disposed at the bases of the hemispherically rounded portions 38 and 40.

Therefore, regardless of the vertical spacing of the bores or indentations in the manufactured bow, the attachment bracket hereinbefore described may be attached by way of securing the central aperture 28 of the attachment bracket to the drill tapped bore 22 of the bow by a suitable screw member 48. The pin members 34 and 36 may then be slidably adjusted within the slots 30 and 32 so that the knob or rounded end portion 38 and 40 seat within the drill location indentations or previously drilled holes in the existing bow structure.

Whereas, one pin member is all that is necessary to prevent the attachement bracket from rotating about the central screw member, two such members are shown herein which conforms with the general range of hole patterns provided in archery bows and naturally provide greater stability than a single pin.

Figure 5:
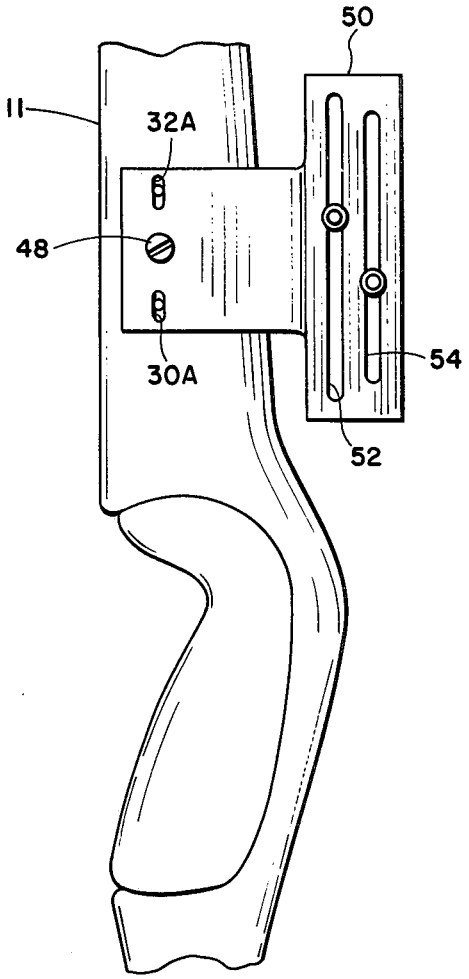
FIG. 5 is a side elevational view of a one piece bow sight bracket embodying the present invention.
Figure 6:
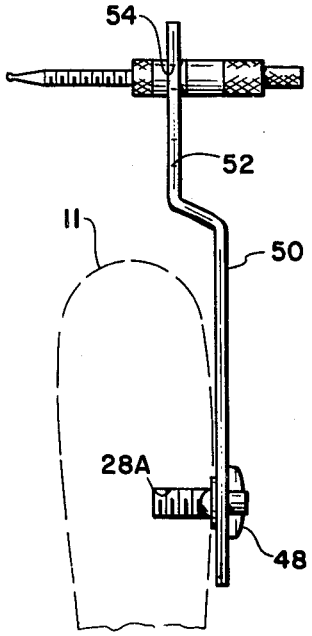
FIG. 6 is a top plan view of the bracket of FIG. 5.

Further, other configurations of the attachment plate or accessories other than bow sights may be constructed utilizing the same general type of hole and slot patterns taught herein. For instance, FIGS. 5 and 6 depict a one piece bow sight bracket 50. The bracket 50 is provided with center bore and radial slots identical to that of the bracket 10 and identified by related reference characters 28A, 30A and 32A, respectively. It is seen that the bow sight pins attach directly to the vertical slots 52 and 54.

Whereas, the present invention has been described in particular relation to the drawings attached hereto, other and further modifications apart from those shown or suggested herein may be made within the spirit and scope of the invention.

What is claimed is:

1. An attachment bracket for use with archery bows having a threaded attachment bore and at least one radially spaced drill indentation, the attachment bracket comprising a plate member, a threaded fastener, a central aperture through the plate member for receiving said threaded fastener therethrough alignable with a bow having threaded attachment bore, at least one elongated slot spaced from the central aperture and having its length radially extending from said aperture, a drill indentation locator means carried by said slot and being longitudinally movable within said slot and engagable with a drill indentation in a bow, whereby upon securing the plate member to a bow by said threaded fastener, said plate is prevented from rotation about the threaded fastener by the locator means being moved to engagement with a drill indentation.

2. A universal attachment bracket as set forth in claim 1 wherein the drill indentation locator means comprises an elongated pin member having an inner end rounded and slidably carried by each slot, and a flange member surrounding the pin member adjacent to the rounded end and larger than the width of the slot.

3. An attachment bracket as set forth in claim 1, wherein said attachment bracket comprises a pair of oppositely disposed elongated slots spaced from the central aperture and radially extending therefrom and a pair of drilled indentation locator means, said pair of locator means being carried by each said slot and longitudinally movable within said slot, each said locator means being engagable with a drill indentation on a bow.

* * * * *